US008763181B1

(12) United States Patent
Penfold et al.

(10) Patent No.: US 8,763,181 B1
(45) Date of Patent: Jul. 1, 2014

(54) MULTIPURPOSE MAT

(76) Inventors: Michael Penfold, East Aurora, NY (US); Nicole Penfold, East Aurora, NY (US)

( * ) Notice: Subject to any disclaimer, the term of this patent is extended or adjusted under 35 U.S.C. 154(b) by 527 days.

(21) Appl. No.: 13/079,387

(22) Filed: Apr. 4, 2011

(51) Int. Cl.
*A47G 19/02* (2006.01)

(52) U.S. Cl.
USPC ..... 5/655; 5/632; 5/420; 5/652; 5/653; 5/656

(58) Field of Classification Search
USPC ..... 5/632, 417, 420, 652, 653, 655, 656; 2/49.1, 49.2, 49.3, 49.4, 49.5
See application file for complete search history.

(56) References Cited

U.S. PATENT DOCUMENTS

| | | | | | |
|---|---|---|---|---|---|
| 2,260,437 | A | * | 10/1941 | Chambers | 5/653 |
| 3,729,037 | A | | 4/1973 | Dare et al. | |
| 3,916,447 | A | * | 11/1975 | Thompson | 2/46 |
| 4,346,875 | A | | 8/1982 | Spencer et al. | |
| 4,660,226 | A | * | 4/1987 | Quilling et al. | 2/49.2 |
| 4,766,626 | A | * | 8/1988 | Green | 5/420 |
| 5,053,262 | A | | 10/1991 | Kerr | |
| 5,203,041 | A | | 4/1993 | Alonso | |
| D371,266 | S | | 7/1996 | Ward | |
| 5,685,257 | A | | 11/1997 | Feibus | |
| 5,829,829 | A | * | 11/1998 | Celestina-Krevh | 297/219.12 |
| 5,842,739 | A | * | 12/1998 | Noble | 297/219.12 |
| 6,065,164 | A | | 5/2000 | Swanger et al. | |
| 6,224,152 | B1 | * | 5/2001 | Hughes et al. | 297/256.17 |
| 6,684,422 | B2 | | 2/2004 | LeFevre et al. | |
| RE38,782 | E | | 8/2005 | Dix | |
| 7,487,560 | B2 | | 2/2009 | McGrath et al. | |
| 7,588,291 | B2 | * | 9/2009 | Gold et al. | 297/219.12 |
| 2003/0152736 | A1 | | 8/2003 | Bass | |
| 2005/0120484 | A1 | * | 6/2005 | Gold et al. | 5/655 |
| 2006/0043134 | A1 | | 3/2006 | Delaney | |
| 2006/0207482 | A1 | | 9/2006 | Bridge et al. | |
| 2008/0115250 | A1 | * | 5/2008 | Tousant | 2/69 |
| 2008/0187709 | A1 | | 8/2008 | Hester et al. | |
| 2008/0272160 | A1 | | 11/2008 | Vou Vakis | |
| 2009/0297743 | A1 | | 12/2009 | Ciaffara et al. | |
| 2010/0015882 | A1 | | 1/2010 | Givens | |
| 2010/0088796 | A1 | | 4/2010 | Perazzo | |
| 2012/0137431 | A1 | * | 6/2012 | Pittman | 5/417 |

FOREIGN PATENT DOCUMENTS

| | | |
|---|---|---|
| JP | 2002000424 | 1/2002 |

* cited by examiner

*Primary Examiner* — William Kelleher
(74) *Attorney, Agent, or Firm* — Simpson & Simpson, PLLC

(57) ABSTRACT

A multipurpose mat including: a first side made from a water-resistant material; a second side fixedly secured to the first side and made from an absorbent material; a plurality of first straps fixedly secured to the first side; and a plurality of second straps fixedly secured to the second side. The first and second sides form a perimeter including first and second protrusions with a recess between the first and second protrusions. Respective straps in the plurality of first straps are connectable to each other or to another strap in the plurality of first straps. Respective straps in the plurality of second straps are connectable to each other or to another strap in the plurality of second straps.

16 Claims, 3 Drawing Sheets

MULTIPURPOSE MAT

FIELD OF THE INVENTION

The invention broadly relates to children's placemats and, more particularly, to a double-sided, multipurpose, eating and play mat for children.

BACKGROUND OF THE INVENTION

U.S. Patent Application Publication No. 2009/0297743 (Ciaffara et al.) and U.S. Patent Application Publication No. 2008/0187709 (Hester et al.) teach a placemat with fixed suction cups on one side to hold the placemat to a surface. Hester et al. also discloses toy holders on the side opposite the suction cups. U.S. Pat. No. 6,684,422 (LeFevre et al.) teaches tie straps on one side of a blanket. The known prior art teaches against using either side of a placemat for securing the placemat or using either side to secure items to the placemat.

BRIEF SUMMARY OF THE INVENTION

The present invention broadly comprises a multipurpose mat including: a first side made from a water-resistant material; a second side fixedly secured to the first side and made from an absorbent material; a plurality of first straps fixedly secured to the first side; and a plurality of second straps fixedly secured to the second side. The first and second sides form a perimeter including first and second protrusions with a recess between the first and second protrusions. Respective straps in the plurality of first straps are connectable to each other or to another strap in the plurality of first straps. Respective straps in the plurality of second straps are connectable to each other or to another strap in the plurality of second straps.

The present invention broadly comprises a multipurpose mat including: a first side made from a water-resistant material; a second side fixedly secured to the first side and made from an absorbent material; a plurality of first straps, fixed to the first side; a plurality of second straps, fixed to the second side; a plurality of first suction cups; and a plurality of straps fixedly connected to the plurality of first suction cups and fixedly connected to the first side, the second side, or the perimeter. The plurality of first suction cups is connectable to the plurality of first straps or the plurality of second straps such that the plurality of first suction cups is engageable with a surface to secure the mat with respect to the surface.

The present invention broadly comprises a multipurpose mat including: a first side made from a water-resistant material; a second side fixedly secured to the first side and made from an absorbent material; a plurality of first straps fixed to the first side; a plurality second straps, fixed to the second side; a perimeter formed by the first and second sides and including first and second protrusions with a recess between the first and second protrusions; a U-shaped channel fixed to the perimeter along at least respective segments of the first and second protrusions such that the channel opens in the same direction as the first or second side; a plurality of openings; a plurality of suction cups; and a plurality of straps fixedly secured to the plurality of suction cups and fixedly secured to the first side, the second side, or the perimeter. The plurality of suction cups is connectable to the plurality of first straps or the plurality of second straps, or is engageable with the plurality of openings. When the plurality of suction cups is connected to the plurality of first straps or to the plurality of second cups, or is engaged with the plurality of openings, the plurality of suction cups is engageable with a surface to secure the mat with respect to the surface. Respective straps from the plurality of first straps are connectable to each other or to another respective strap from the plurality of first straps to hold an item against the first side. Respective straps from the plurality of second straps are connectable to each other or to another respective strap from the plurality of second straps to hold an item against the second side. The first and second parallel protrusions and the recess are positionable proximate a torso of a child and partially about the torso of the child.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. It is to be understood that the invention as claimed is not limited to the disclosed aspects.

Furthermore, it is understood that this invention is not limited to the particular methodology, materials and modifications described and, as such, may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs.

Figure 1:
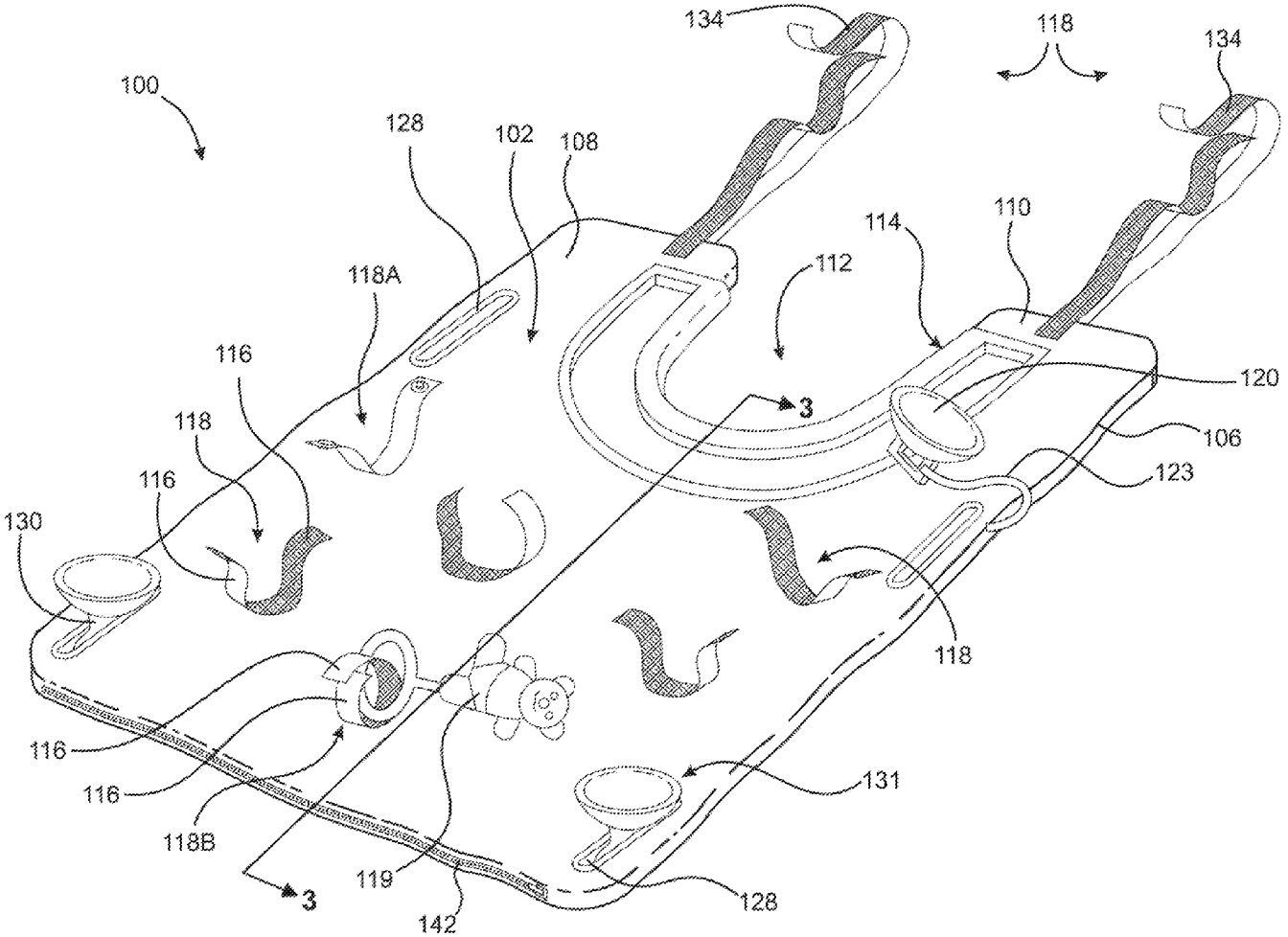
FIG. 1 is a top perspective view of a multipurpose mat.

FIG. 1 is a top perspective view of multipurpose mat 100.

Figure 2:
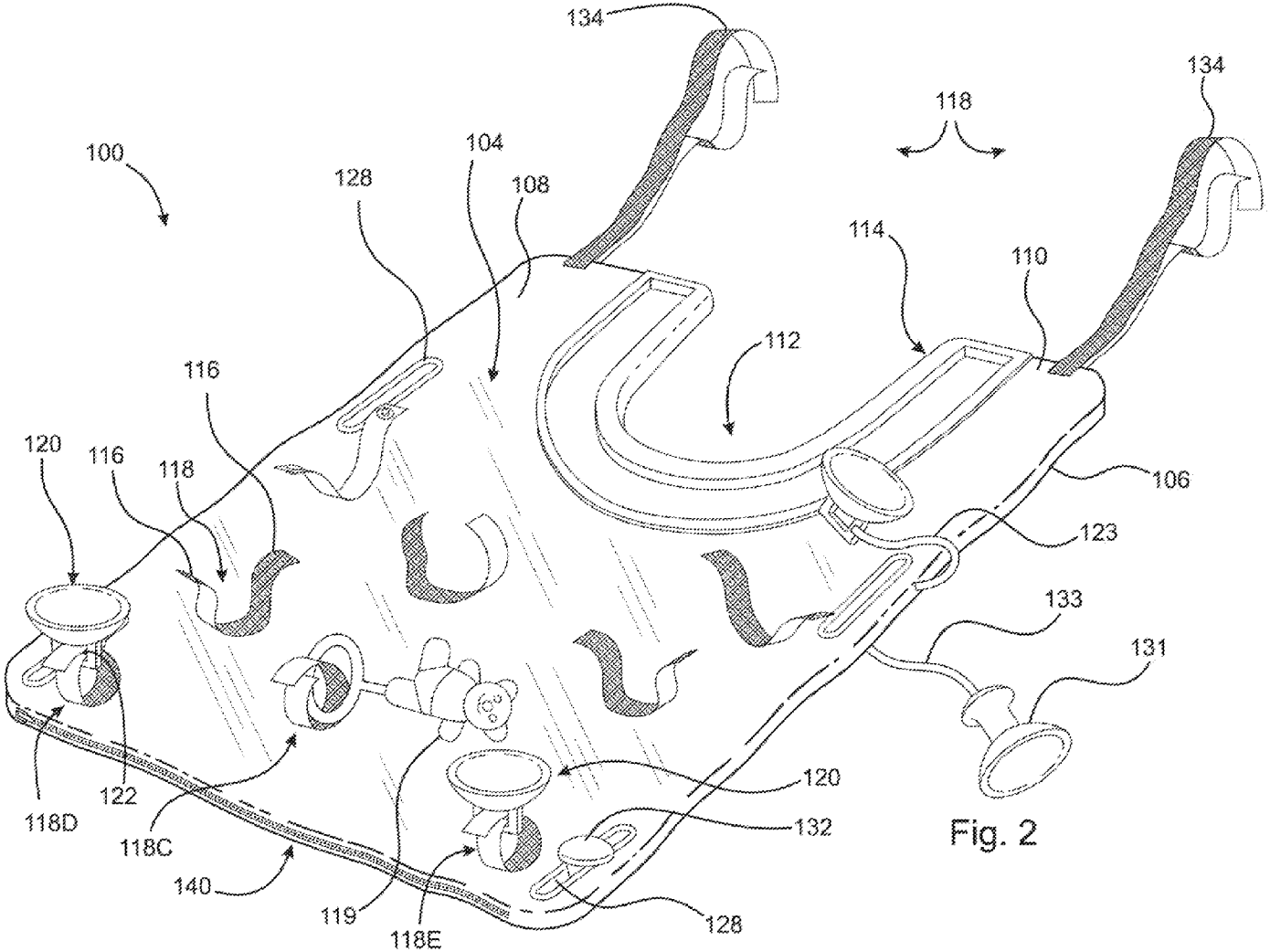
FIG. 2 is a bottom perspective view of the multipurpose mat shown in FIG. 1; and, FIG. 3 is a cross-sectional view of the multipurpose mat shown in FIG. 1 along line 3-3 in FIG. 1.

FIG. 2 is a bottom perspective view of multipurpose mat 100 shown in FIG. 1.

Figure 3:
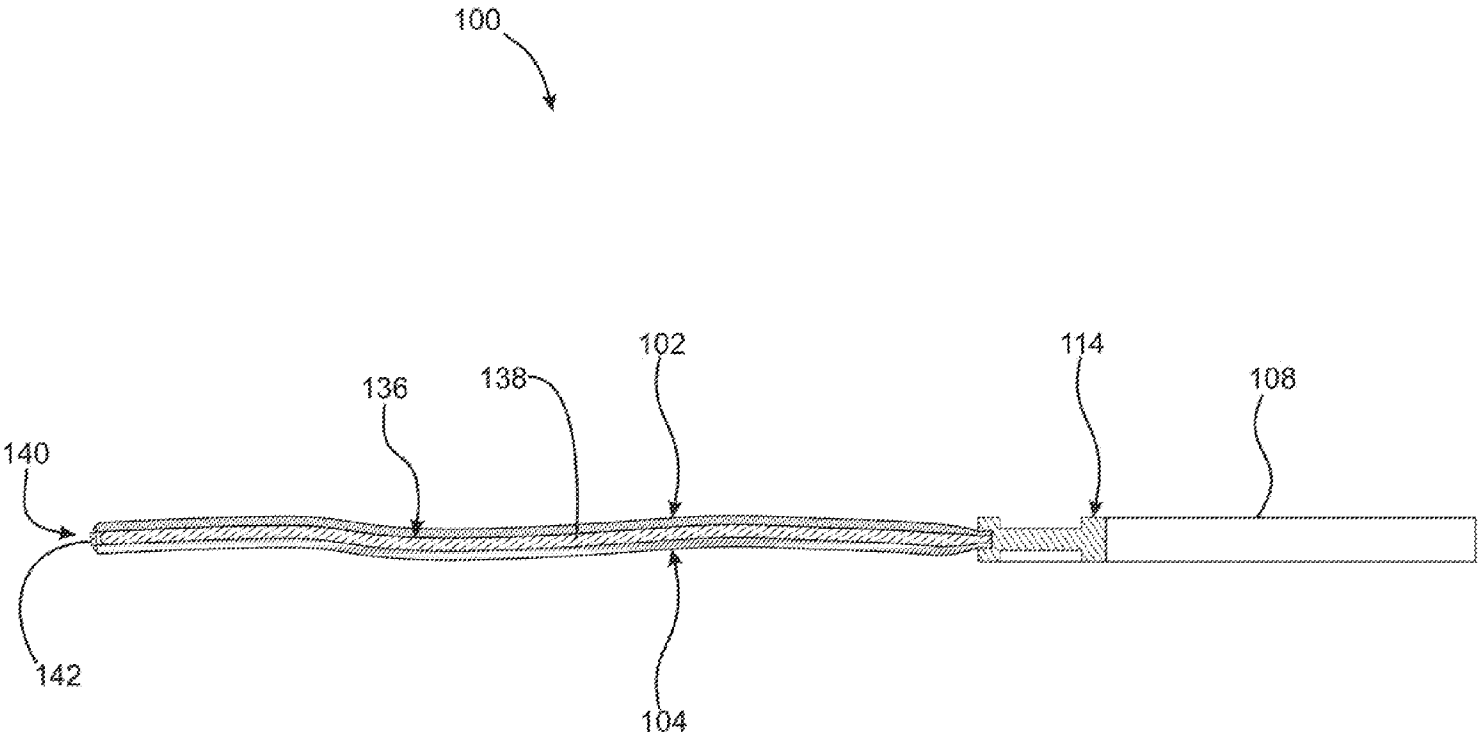

FIG. 3 is a cross-sectional view of multipurpose mat 100 shown in FIG. 1 along line 3-3 in FIG. 1. The following should be viewed in light of FIGS. 1 through 3. Multipurpose mat 100 includes sides 102 and 104. In an example embodiment, side 102 is made from an absorbent material and side 104 is made from a water-resistant material. Sides 102 and 104 are joined, for example, by stitching, at perimeter 106. It should be understood that any means known in the art can be used to join sides 102 and 104. In an example embodiment, the mat includes protrusions 108 and 110 with recess 112 between the protrusions. Thus, the protrusions and the recess form a U-shape. The protrusions and the recess are positionable proximate a torso of a child and partially about the torso of the child to minimize a gap between the child and the mat, for example, to prevent objects, such as toys or food, from slipping between the mat and the child.

In an example embodiment, the mat includes U-shaped channel 114 fixed to the perimeter, by any means known in the art, in the recess and along at least respective segments of the protrusions. The channel can open to one or both of sides 102 and 104.

The mat includes a plurality of straps 116 fixed to both of sides 102 and 104 by any means known in the art, for example, by stitching. That is, some straps 116 are fixed to side 102 and other straps 116 are fixed to side 104. In an example embodiment, some or all of straps 116 are grouped into pairs 118. Each strap 116 is connectable to itself or to another strap 116, for example, another strap 116 forming a pair 118 with that strap. Straps 116 are connectable to themselves or another strap 116 by any means known in the art, including respective loop and hook configurations or snap connections, for example as shown for pair 118A. Straps 116 can be used to secure an item, such as a toy, to the mat, for example, holding the item against side 102 or 104. In FIGS. 1 and 2, pairs 118B and 118C are shown holding items 119.

In an example embodiment, the mat includes a plurality of suction cups 120. Straps 116 can be used to connect the suction cups to the mat, for example at side 102, side 104, or the perimeter. In FIG. 2, for example, pairs 118D and 118E are used to connect respective suction cups to side 104. The suction cups are attachable to straps 116 by any means known in the art, for example, via openings or slots 122 in the suction cups. The suction cups are displaceable such that respective suction cups are connectable to respective straps 116 or pairs 118 as further described below. When some or all of the suction cups are connected to one or more straps 116, the respective suction cup can be used to engage a surface to secure the mat with respect to the surface and with side 102 or 104 facing the surface. For example, when the suction cups are connected to straps 116 on side 102, the mat can be secured to the surface with side 102 facing the surface and side 104 facing away from the surface. That is, the suction cups are secured with respect to the mat and engage the surface. In an example embodiment, one or more cups 120 are attached to the mat, for example, at the perimeter, by straps 123.

In an example embodiment, the mat includes a plurality of coupling elements 128 on one or both sides of the mat. In an example embodiment, one or more of the elements are disposed inward of the perimeter. Elements 128 are used to attach respective attachment elements, such as suction cups, to the mat by any means known in the art. The coupling elements can be any coupling elements known in the art, including hooks, buttons, openings, magnetic fasteners, snap fasteners, or adhesives. In an example embodiment, elements 128 are openings passing through the mat. In an example embodiment, stem portion 130 of suction cups 131 pass through the opening and distal end 132 of cups 131 extends past the opening to the opposite side of the mat. For example, portion 130 of a suction cup is passed through an opening from side 102 and end 132 extends through the opening to side 104 as shown in FIGS. 1 and 2.

In an example embodiment, cups 131 are attached to mat 100, for example, along perimeter 106 by any means known in the art, such as straps 133. Suction cups connected to respective elements 128 can be used to engage a surface to secure the mat with respect to the surface and with side 102 or 104 facing the surface. For example, as shown in FIGS. 1 and 2, side 102 would face the surface. In an example embodiment, cups 120 and 131 are interchangeable, for example, the cups include a means for attachment to straps 116 and to elements 128.

In an example embodiment, the mat includes straps 134 connected to protrusions 108 or 110. Straps 134 can be used to connect the mat to a chair or other piece of furniture in which a child is seated in order to secure the mat and maintain protrusions 108 and 110 in respective desired positions, for example, proximate a child's torso.

The following provides further detail regarding mat 100. Mat 100 is a multipurpose eating and play mat for children. The mat comprises a dual side, or layer, of flexible materials. Side 104 has a wipeable, water-resistant surface and can be made of any flexible, water-resistant material known in the art, including various plastics. Side 102 has a soft surface made of any absorbent, or water permeable, material known in the art including material made of one or both of natural and synthetic fibers or substances. The sides are connected using any means known in the art, including stitching.

In an example embodiment, sides 102 and 104 form space, or pocket, 136 between the sides. In an example embodiment, layer 138 of material is disposed in the pocket. Layer 138 can be a padding material of any type known in the art. In an example embodiment, closeable opening 140 provides access to the pocket. In an example embodiment, opening 140 is formed along some or all of the perimeter and includes a button closure, a snap closure, or any other closing means known in the art. Zipper 142 is shown as an example for the closure in the figures. In an example embodiment, layer 138 fills all of pocket 136 including the portion of the pocket associated with the protrusions.

It should be understood that any means known in the art, such as buttons, openings, magnetic fasteners, or snap fasteners, can be used to enable a strap 134 to be secured to itself or to the other strap 134. In an example embodiment, straps 134 includes respective hook or loop fastening means to enable a respective strap 134 to be secured to itself or to the other strap 134. Straps 134 can be used to removably attach the mat to a high chair, any chair in which the child is sitting, or any piece of furniture. Straps 134 also are for securing the folded rolled up mat into a convenient, self-contained package.

In an example embodiment, straps 116 are made of a flexible cloth material and at least respective portions of the straps are made of an elastic or stretchy material. It should be understood that any means known in the art, such as buttons, openings, magnetic fasteners, or snap fasteners, can be used to enable a respective strap 116 to be secured to itself or to another strap 116. In an example embodiment, straps 116 include respective hook and loop fastening means to enable a respective strap 116 to be secured to itself or to another strap 116. When straps 116 are fastened to themselves or to other straps 116, respective loops are formed, which are usable to engage a suction cup or other attachment elements or removably secure a child's plaything.

In an example embodiment, openings 128 are located in opposing corners of the mat to removably receive and secure suction cups. In an example embodiment, the opening is a buttonhole type slit.

Suction cups 120 or 131 enable either side of the mat to be secured to a flat surface when the opposing side is arranged face up. For example, for suction cups secured by straps 116 on side 102 or passing through openings 128 such that the suction portion of the suction cup faces in the same direction as side 102, the suction cups are adapted to releasably secure the mat to a surface, such as a table or a baby chair extension table, with side 104 facing upward.

Straps 123 and 133 enable suction cups 120 and 131 to remain attached to the mat, enable the suction cups to reach straps 116 on either side of the mat, enable the suction cups to reach elements 128, and prevent the cups from being separated from the mat. In addition, straps 116, 123, and 133 also inhibit a child from placing a loose item or suction cup into their mouth, preventing possible choking hazards.

In an example embodiment, channel 114 is made of a flexible material, such as polyurethane. The channel captures liquids spilled on the mat and prevents these liquids from reaching the child.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What we claimed is:

1. A multipurpose mat comprising:

a first side made from a water-resistant material;

a second side fixedly secured to the first side and made from an absorbent material;

a plurality of first straps fixedly secured to the first side; and, a plurality of second straps fixedly secured to the second side, wherein:

the first and second sides form a perimeter including first and second protrusions with a recess between the first and second protrusions;

respective straps in the plurality of first straps are connectable to each other or to another strap in the plurality of first straps; and, respective straps in the plurality of second straps are connectable to each other or to another strap in the plurality of second straps, the multipurpose mat further comprising a U-shaped channel fixed to the perimeter along at least respective segments of the first and second protrusions such that the channel opens in the same direction as the first or second side.

2. The multipurpose mat of claim 1 wherein:

respective straps in the plurality of first straps are connectable to each other or to another strap in the plurality of first straps to hold an item against the first side; and, respective straps in the plurality of second straps are connectable to each other or to another strap in the plurality of second straps to hold an item against the second side.

3. The multipurpose mat of claim 1 wherein:

the plurality of first straps includes at least one pair of first straps; or, the plurality of second straps includes at least one pair of second straps.

4. The multipurpose mat of claim 1 wherein the first and second parallel protrusions and the recess are positionable proximate a torso of a child and partially about the torso of the child.

5. The multipurpose mat of claim 1 further comprising a plurality of openings disposed inward of the perimeter, wherein one or more respective first or second straps, or each opening in the plurality of openings, are arranged to engage a respective attachment element so that the mat is securable with respect to a surface via the respective attachment elements.

6. The multipurpose mat of claim 5 wherein the respective attachment element is a suction cup.

7. The multipurpose mat of claim 6 wherein the suction cup is connected to the first side, the second side, or the perimeter with a strap.

8. The multipurpose mat recited in claim 1 further comprising:

at least one suction cup; and, at least one strap fixedly secured at a first end to the at least one suction cup and fixedly secured at a second end to the first side, the second side, or the perimeter, wherein the at least one suction cup is connectable to at least one first strap from the plurality of first straps or to at least one second strap from the plurality of second straps such that the at least one suction cup is engageable with a surface to secure the mat with respect to the surface.

9. The multipurpose mat recited in claim 1 further comprising:

at least one opening;

at least one suction cup; and, at least one strap fixedly secured at a first end to the at least one suction cup and fixedy secured at a second end to the first side, the second side, or the perimeter, wherein the at least one suction cup is engageable with the at least one opening such that the at least one suction cup is engageable with a surface to secure the mat with respect to the surface.

10. The multipurpose mat recited in claim 1 further comprising third and fourth straps fixed to the first and second protrusions, respectively, and arranged to secure the mat to a piece of furniture in which a child is seated.

11. A multipurpose mat comprising:

a first side made from a water-resistant material;

a second side fixedly secured to the first side and made from an absorbent material;

a plurality of first straps, fixed to the first side;

a plurality of second straps, fixed to the second side;

a plurality of first suction cups; and, a plurality of straps fixedly connected to the plurality of first suction cups and fixedly connected to the first side, the second side, or the perimeter, wherein:

the plurality of first suction cups is connectable to the plurality of first straps or the plurality of second straps such that the plurality of first suction cups is engageable with a surface to secure the mat with respect to the surface;

the first and second sides form a perimeter including first and second protrusions with a recess between the first and second protrusions; and, the first and second parallel protrusions and the recess are positionable proximate a torso of a child and partially about the torso of the child, the multipurpose mat further comprising a U-shaped channel fixed to the perimeter along at least respective segments of the first and second protrusions such that the channel opens in the same direction as the first or second side.

12. The multipurpose mat of claim 11 wherein:

respective straps from the plurality of first straps are connectable to themselves or to another respective strap from the plurality of first straps to hold an item against the first side; and, respective straps from the plurality of second straps are connectable to themselves or to another respective strap from the plurality of second straps to hold an item against the second side.

13. The multipurpose mat of claim 11 further comprising third and fourth straps fixed to the first and second protrusions, respectively, and arranged to secure the mat to a piece of furniture in which the child is seated.

14. The multipurpose mat of claim 11 wherein the first and second sides form a perimeter, the mat further comprising a plurality of openings disposed inward of the perimeter, wherein each opening in the plurality of openings is arranged to engage a respective attachment element so that the respective attachment element is positioned to secure the mat with respect to the surface.

15. The multipurpose mat of claim 14 wherein the respective attachment element is a second suction cup or a first suction cup from the plurality of first suction cups.

16. A multipurpose mat comprising:

a first side made from a water-resistant material;

a second side fixedly secured to the first side and made from an absorbent material;

a plurality of first straps fixed to the first side;

a plurality second straps, fixed to the second side;

a perimeter formed by the first and second sides and including first and second protrusions with a recess between the first and second protrusions;

a U-shaped channel fixed to the perimeter along at least respective segments of the first and second protrusions such that the channel opens in the same direction as the first or second side;

a plurality of openings;

a plurality of suction cups; and, a plurality of straps fixedly secured to the plurality of suction cups and fixedly secured to the first side, the second side, or the perimeter, wherein:

the plurality of suction cups is connectable to the plurality of first straps or the plurality of second straps, or is engageable with the plurality of openings;

when the plurality of suction cups is connected to the plurality of first straps or to the plurality of second cups, or is engaged with the plurality of openings, the plurality of suction cups is engageable with a surface to secure the mat with respect to the surface;

respective straps from the plurality of first straps are connectable to each other or to another respective strap from the plurality of first straps to hold an item against the first side;

respective straps from the plurality of second straps are connectable to each other or to another respective strap from the plurality of second straps to hold an item against the second side; and, the first and second parallel protrusions and the recess are positionable proximate a torso of a child and partially about the torso of the child.

* * * * *